US011021933B1

(12) United States Patent
Webb

(10) Patent No.: US 11,021,933 B1
(45) Date of Patent: Jun. 1, 2021

(54) WELL HOLE CLEANING TOOL

(71) Applicant: David A. Webb, Mustang, OK (US)

(72) Inventor: David A. Webb, Mustang, OK (US)

( * ) Notice: Subject to any disclaimer, the term of this patent is extended or adjusted under 35 U.S.C. 154(b) by 44 days.

(21) Appl. No.: 16/130,289

(22) Filed: Sep. 13, 2018

Related U.S. Application Data

(60) Provisional application No. 62/557,781, filed on Sep. 13, 2017.

(51) Int. Cl.
*E21B 37/00* (2006.01)
*E21B 43/08* (2006.01)
*E21B 17/10* (2006.01)

(52) U.S. Cl.
CPC ..... *E21B 37/00* (2013.01); *E21B 17/1078* (2013.01); *E21B 43/08* (2013.01)

(58) Field of Classification Search
CPC ..... E21B 37/00; E21B 21/00; E21B 43/121; E21B 43/08; E21B 17/1078
See application file for complete search history.

(56) References Cited

U.S. PATENT DOCUMENTS

| | | | | |
|---|---|---|---|---|
| 3,406,757 | A * | 10/1968 | Baumstimler | E21B 27/00 166/99 |
| 3,651,867 | A * | 3/1972 | Baumstimler | E21B 27/00 166/99 |
| 4,373,587 | A | 2/1983 | Pringle | |
| 4,421,182 | A | 12/1983 | Moody et al. | |
| 6,719,071 | B1 | 4/2004 | Moyes | |
| 7,311,150 | B2 | 12/2007 | Zupanick | |
| 7,549,477 | B2 | 6/2009 | Khoshnevis | |
| 2006/0201714 | A1 | 9/2006 | Seams et al. | |
| 2009/0025927 | A1 | 1/2009 | Telfer | |
| 2013/0048293 | A1 | 2/2013 | Tienda et al. | |

* cited by examiner

*Primary Examiner* — Catherine Loikith
(74) *Attorney, Agent, or Firm* — Cramer Patent & Design, PLLC; Aaron R. Cramer

(57) ABSTRACT

A well hole cleaning tool includes a plurality of tubular subcomponents arranged in a string-like fashion, having a plurality of flapper valves disposed above a notched collar, a wash pipe shoe, a bit and a mill. An upper stabilizer is disposed above a lower stabilizer which in turn is disposed above a sand screen. When in operation, the tool creates a vacuum at the lower end which facilitates flow of debris and waste water upward and out of the well hole.

14 Claims, 2 Drawing Sheets

WELL HOLE CLEANING TOOL

RELATED APPLICATIONS

The present invention is a Continuation of and claims the benefit of U.S. Application No. 62/557,781, filed Sep. 13, 2018, the entire disclosures of which are incorporated herein by reference.

FIELD OF THE INVENTION

The present invention relates generally to a well hole cleaning device.

BACKGROUND OF THE INVENTION

As anyone who performs a lot of mechanical work will attest, nothing beats having the proper tool for a job. The proper tool can save time, save money, produce a higher quality job, reduce damage to equipment, and provide for the increased safety of the worker.

Each field of mechanical work has its own type of specialty tools with each tool performing a specialized task. One (1) field where there has been a need for highly specialized tools is that of the oil and gas drilling industry. During drilling operations, it is typically necessary to remove unwanted liquids and solids from the drill hole including sand, water, fracking compounds, and general debris. Usually, this is performed by a separate dedicated pump which takes a great deal of time to position and operate.

As such, there exists a need for a means by which unwanted solids and liquids can be removed from wells that are actively being drilled. The development of the well hole cleaning tool fulfills this need.

SUMMARY OF THE INVENTION

To achieve the above and other objectives, the present invention provides for a well hole cleaning tool, comprising a drive motor which is secured above a splined connector housing, a tubing string connector which is disposed in a distal end of the drive motor, a drive shaft housing which has a drive shaft secured beneath the splined connector housing, a flow housing which is secured beneath the drive shaft housing, at least one thrust bearing which is secured between the drive motor and the splined connector housing and within the splined connector housing is at least one splined connector, a drive shaft which is centrally secured within the drive shaft housing and is in mechanical communication with the drive motor, an upper stabilizer separating the splined connector housing and the drive shaft housing, a lower stabilizer separating the drive shaft housing and the flow housing, a sand screen lower support separating the flow housing from the tubing tail pipe housing and a tubing tail pipe disposed at a distal end of the tubing tail pipe housing.

The well hole cleaning tool may terminate with a tubing tail pipe housing which is secured beneath the flow housing. The well hole cleaning tool may also comprise a cross section of the splined connector housing comprises a plurality of alternating drive motor discharge apertures and a plurality of pump discharge apertures. While an additional version may also further comprise a cross section of the splined connector housing having a plurality of alternating drive motor discharge apertures and a plurality of pump discharge apertures—drive shaft is centrally located in a cross section of the upper stabilizer.

The drive motor discharge apertures may be in fluid communication with the interior of the drive motor while the pump discharge apertures are in fluid communication with the interior of the drive shaft housing and flow housing. The drive shaft may be centrally located in the cross section of the splined connector housing. The well hole cleaning tool may terminate with a tubing tail pipe housing which is secured beneath the flow housing.

The well hole cleaning tool may withdraw sediment and fluids from a well hole, which is accomplished when the drive motor is rotated in a first direction necessitating rotation of the drive shaft which creates a negative pressure above the sediment and fluids in the well hole thereby forcing them up into the tubing tail pipe and through the well hole cleaning tool and out of the hole. The well hole cleaning tool may also have an overall length of thirty-four feet.

The drive motor discharge apertures may be in fluid communication with the interior of the drive motor while the pump discharge apertures are in fluid communication with the interior of the drive shaft housing and flow housing. The drive shaft may be centrally located in the cross section of the splined connector housing and may also located in the cross section of the upper stabilizer.

The well hole cleaning tool may terminate with a tubing tail pipe housing which is secured beneath the flow housing. The well hole cleaning tool may withdraw sediment and fluids from a well hole, which is accomplished when the drive motor is rotated in a first direction necessitating rotation of the drive shaft which creates a negative pressure above the sediment and fluids in the well hole thereby forcing them up into the tubing tail pipe and through the well hole cleaning tool and out of the hole.

The well hole cleaning tool may be removed from the well and normal drilling activities could then recommence once the liquid and debris has been extracted and may have an overall length of thirty-four feet and/or be made of steel. The well hole cleaning tool is designed for use with one or more oil and gas wells that are currently in production.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
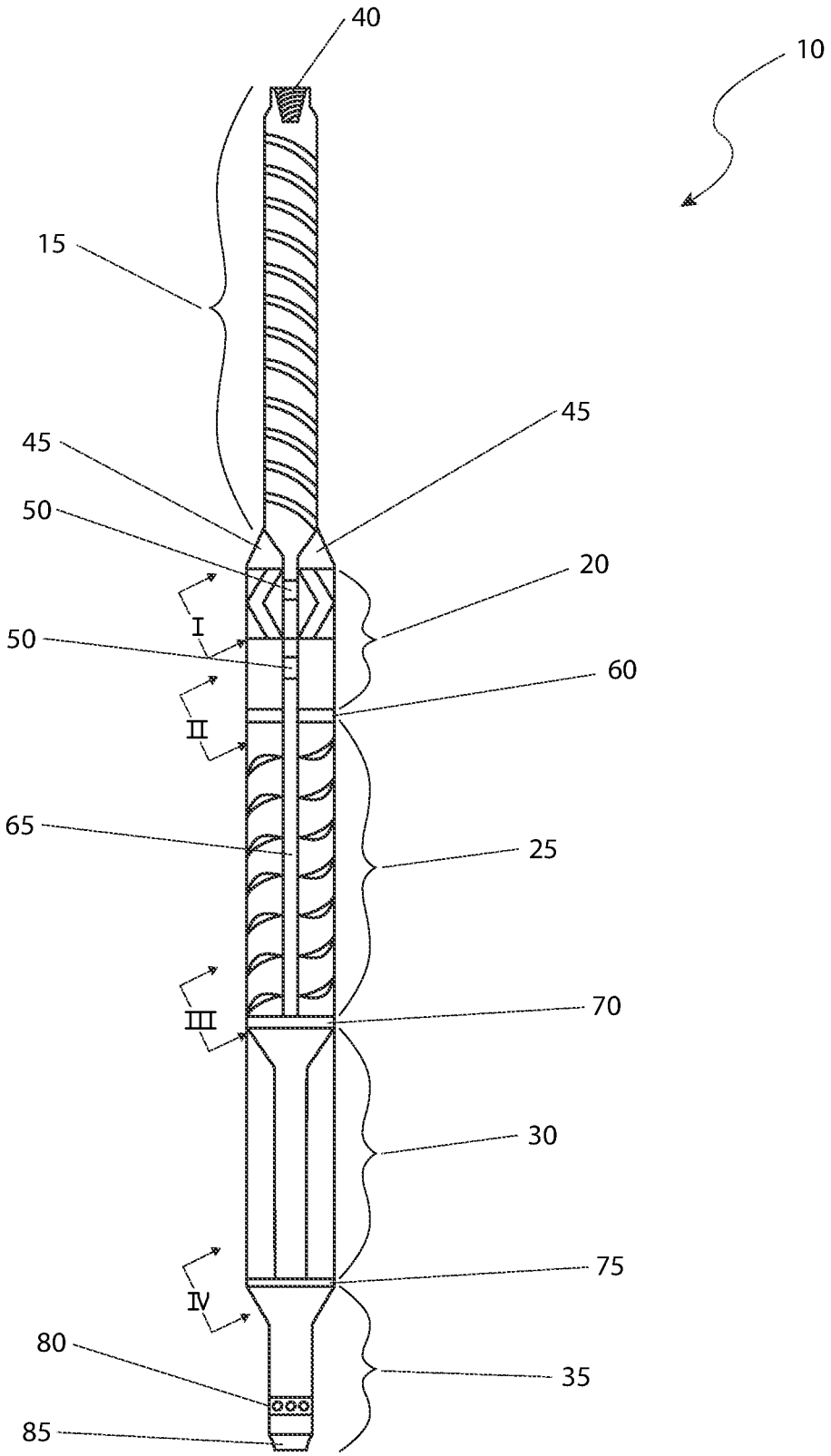
FIG. 1 is a sectional view of an well hole cleaning tool 10, according to the preferred embodiment of the present invention.

10 well hole cleaning tool
15 drive motor

20 splined connector housing
25 drive shaft housing
30 flow housing
35 tubing tail pipe housing
40 tubing string connection
45 thrust bearing
50 splined connectors
60 upper stabilizer
65 drive shaft
70 lower stabilizer
75 sand screen lower support
80 shear safety joint
85 tubing tail pipe
90 drive motor discharge aperture
95 pump discharge aperture
100 thrust bearing
110 lower support

IV. DESCRIPTION OF THE INVENTION

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

1. Detailed Description of the Figures

Referring now to FIG. 1, a sectional view of a well hole cleaning tool 10 (hereinafter the 'device'), according to the preferred embodiment of the present invention, is disclosed. The device 10 comprises a drive motor 15 secured above a splined connector housing 20. A tubing string connector 40 is disposed in the distal end of the drive motor 15. A drive shaft housing 25 having a drive shaft 65 is secured beneath the splined connector housing 20. A flow housing 30 is secured beneath the drive shaft housing 25. The device 10 terminates with a tubing tail pipe housing 35 which is secured beneath the flow housing 30. Secured between the drive motor 15 and the splined connector housing 20 is at least one (1) thrust bearing 45. Within the splined connector housing 20 is at least one (1) splined connector 50. A drive shaft 65 is centrally secured within the drive shaft housing 25 and is in mechanical communication with the drive motor 15. An upper stabilizer 60 separates the splined connector housing 20 and drive shaft housing 25. A lower stabilizer 70 separates the drive shaft housing 25 and flow housing 30. A sand screen lower support 75 separates the flow housing 30 from the tubing tail pipe housing 35. A tubing tail pipe 85 is disposed at the distal end of the tubing tail pipe housing 35. The tubing tail pipe housing 35 also comprises a shear safety joint 80. The device 10 is configured to withdraw sediment and fluids from a well hole. This is accomplished when the drive motor 15 is rotated in a first direction necessitating rotation of the drive shaft 65 which creates a negative pressure above the sediment and fluids in the well hole thereby forcing them up into the tubing tail pipe 85 and through the device 10 and out of the hole. The overall length of the well hole cleaning tool 10 is approximately thirty-four feet (34 ft.).

Figure 2:
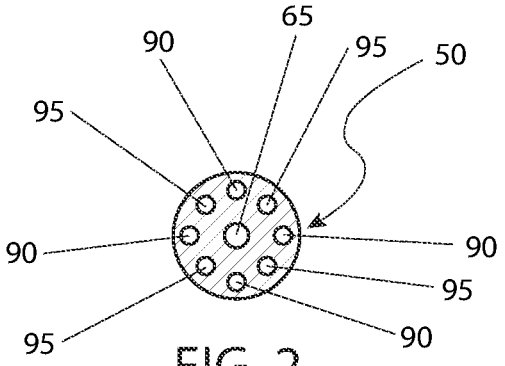
FIG. 2 is cross section of the well hole cleaning tool 10 taken along Line 2-2 in FIG. 1, according to the preferred embodiment of the present invention.

Referring now to FIG. 2, a cross-section of the device 10 taken along line I in FIG. 1, according to the preferred embodiment of the present invention, is disclosed. The cross-section of the splined connector housing 50 comprises alternating drive motor discharge apertures 90 and pump discharge apertures 95. The drive motor discharge apertures 90 are in fluid communication with the interior of the drive motor 15. The pump discharge apertures 95 are in fluid communication with the interior of the drive shaft housing 25 and flow housing 30, the drive shaft housing 25 and the flow housing 30. The drive shaft 65 is centrally located in the cross section 50 of the splined connector housing.

Figure 3:
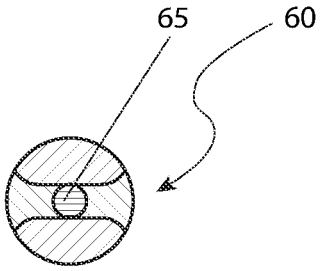
FIG. 3 is cross section of the well hole cleaning tool 10 taken along Line 3-3 in FIG. 1, according to the preferred embodiment of the present invention.

Referring now to FIG. 3, a cross-section of the device 10 taken along line II in FIG. 1, according to the preferred embodiment of the present invention is disclosed. As with FIG. 2 above, the drive shaft 65 is centrally located in the cross-section of the upper stabilizer 60.

Figure 4:
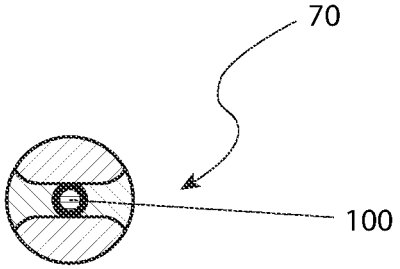
FIG. 4 is cross section of the well hole cleaning tool 10 taken along Line 4-4 in FIG. 1, according to the preferred embodiment of the present invention; and, FIG. 5 is cross section of the well hole cleaning tool 10 taken along Line 5-5 in FIG. 1, according to the preferred embodiment of the present invention.

Referring now to FIG. 4, a cross-section of the device 10 taken along line III in FIG. 1, according to the preferred embodiment of the present invention is disclosed. The cross-section illustrates the central location of a thrust bearing 100.

Figure 5:
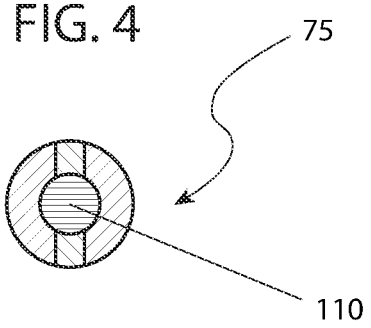

Lastly, referring now to FIG. 5, a cross-section of the device 10 taken along line IV-IV in FIG. 1, according to the preferred embodiment of the present invention is disclosed. The cross-section illustrates the centrally located lower support 110.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5.

The device 10 would be manufactured primarily of steel or similarly durable material used in the oil and gas industry. To utilize the device 10, it would be lowered into a given well and activated by placing the device 10 in mechanical communication with a rotational device (not shown) secured to the tubing string connection 40. Once the liquid and debris has been extracted, the device may be removed from the well and normal drilling activities could then recommence.

These features are envisioned to be ideal for use on oil and gas wells that are currently in production and with production falling off rapidly. This reduction is likely due to sand collecting in low spots. Conventional remediation dictates the pumping down of saltwater to improve circulation. However, this is not always successful for various reasons.

The teachings of the present invention allow for cleaning out of sand from a producing well without "Sticking/Planting" the work string in the lateral section. Additionally, the present invention uses less liquid (water) to clean out the well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A well hole cleaning tool, comprising:

a drive motor secured directly above a splined connector housing;

a tubing string connector disposed in a distal end of the drive motor;

a drive shaft housing having a drive shaft secured beneath the splined connector housing;

a flow housing secured beneath the drive shaft housing;

at least one thrust bearing secured between the drive motor and the splined connector housing, within the splined connector housing is at least one splined connector;

an upper stabilizer separating the splined connector housing and the drive shaft housing;

a lower stabilizer separating the drive shaft housing and the flow housing;

a sand screen lower support separating the flow housing from a tubing tail pipe housing; and a tubing tail pipe disposed at a distal end of the tubing tail pipe housing;

wherein the drive shaft is centrally secured within the drive shaft housing and is in mechanical communication with the drive motor; and wherein the well hole cleaning tool terminates with the tubing tail pipe housing which is secured beneath the flow housing.

2. A well hole cleaning tool lowered into a given well and activated by placing the well hole cleaning tool in mechanical communication with a rotational device secured to a tubing string connection, comprising:

a drive motor secured directly above a splined connector housing;

a tubing string connector disposed in a distal end of the drive motor;

a drive shaft housing having a drive shaft secured beneath the splined connector housing;

a flow housing secured beneath the drive shaft housing;

at least one thrust bearing secured between the drive motor and the splined connector housing;

an upper stabilizer separating the splined connector housing and the drive shaft housing;

a lower stabilizer separating the drive shaft housing and the flow housing;

a sand screen lower support separating the flow housing from a tubing tail pipe housing;

a tubing tail pipe disposed at a distal end of the tubing tail pipe housing, the tubing tail pipe housing includes a shear safety joint; and a cross section of the splined connector housing having a plurality of alternating drive motor discharge apertures and a plurality of pump discharge apertures;

wherein the drive shaft is centrally secured within the drive shaft housing and is in mechanical communication with the drive motor;

wherein the well hole cleaning tool terminates with the tubing tail pipe housing which is secured beneath the flow housing;

wherein the drive motor discharge apertures are in fluid communication with an interior of the drive motor; and wherein the pump discharge apertures are in fluid communication with an interior of the drive shaft housing and flow housing.

3. The well hole cleaning tool according to claim 2, wherein the drive shaft is centrally located in the cross section of the splined connector housing.

4. The well hole cleaning tool according to claim 2, wherein the well hole cleaning tool withdraws sediment and fluids from a well hole, which is accomplished when the drive motor is rotated in a first direction necessitating rotation of the drive shaft which creates a negative pressure above the sediment and fluids in the well hole thereby forcing them up into the tubing tail pipe and through the well hole cleaning tool and out of the hole.

5. The well hole cleaning tool according to claim 2, wherein the well hole cleaning tool has an overall length of thirty-four feet.

6. A well hole cleaning tool lowered into a given well and activated by placing the well hole cleaning tool in mechanical communication with a rotational device secured to a tubing string connection, comprising:

a drive motor secured directly above a splined connector housing;

a tubing string connector disposed in a distal end of the drive motor;

a drive shaft housing having a drive shaft secured beneath the splined connector housing;

a flow housing secured beneath the drive shaft housing;

at least one thrust bearing secured between the drive motor and the splined connector housing, within the splined connector housing is at least one splined connector;

an upper stabilizer separating the splined connector housing and the drive shaft housing;

a lower stabilizer separating the drive shaft housing and the flow housing;

a sand screen lower support separating the flow housing from a tubing tail pipe housing;

a tubing tail pipe disposed at a distal end of the tubing tail pipe housing, the tubing tail pipe housing includes a shear safety joint; and a cross section of the splined connector housing having a plurality of alternating drive motor discharge apertures and a plurality of pump discharge apertures, the drive shaft is centrally located in a cross section of the upper stabilizer;

wherein the drive shaft is centrally secured within the drive shaft housing and is in mechanical communication with the drive motor; and wherein the well hole cleaning tool terminates with the tubing tail pipe housing which is secured beneath the flow housing.

7. The well hole cleaning tool according to claim 6, wherein the drive motor discharge apertures are in fluid communication with an interior of the drive motor.

8. The well hole cleaning tool according to claim 6, wherein the pump discharge apertures are in fluid communication with an interior of the drive shaft housing and flow housing.

9. The well hole cleaning tool according to claim 6, wherein the drive shaft is centrally located in the cross section of the splined connector housing.

10. The well hole cleaning tool according to claim 6, wherein the well hole cleaning tool withdraws sediment and fluids from a well hole, which is accomplished when the drive motor is rotated in a first direction necessitating rotation of the drive shaft which creates a negative pressure above the sediment and fluids in the well hole thereby forcing them up into the tubing tail pipe and through the well hole cleaning tool and out of the hole.

11. The well hole cleaning tool according to claim 6, wherein the well hole cleaning tool is removed from the well and drilling activities.

12. The well hole cleaning tool according to claim 6, wherein the well hole cleaning tool has an overall length of thirty-four feet.

13. The well hole cleaning tool according to claim 6, wherein the well hole cleaning tool is made of steel.

14. The well hole cleaning tool according to claim 6, wherein the well hole cleaning tool is for one or more oil and gas wells that are currently in production and used within the industry.

* * * * *